US006468123B1

(12) United States Patent
Valencia

(10) Patent No.: US 6,468,123 B1
(45) Date of Patent: Oct. 22, 2002

(54) FLYING DISK

(76) Inventor: Carlos Valencia, 17415 NW. 75 Pl. #101, Miami, FL (US) 33015

( * ) Notice: Subject to any disclaimer, the term of this patent is extended or adjusted under 35 U.S.C. 154(b) by 0 days.

(21) Appl. No.: 10/156,018

(22) Filed: May 28, 2002

(51) Int. Cl.[7] ..... A63B 65/10
(52) U.S. Cl. ..... 446/48; 473/588
(58) Field of Search ..... 446/46, 47, 48; 473/588, 589, 590

(56) References Cited

U.S. PATENT DOCUMENTS

| | | | | | |
|---|---|---|---|---|---|
| D172,112 | S | | 5/1954 | Shoemaker | |
| D193,245 | S | | 7/1962 | Knox | |
| D214,577 | S | | 7/1969 | Mueller | |
| 3,939,602 | A | | 2/1976 | Burke et al. | |
| 4,246,720 | A | * | 1/1981 | Stone | 446/47 |
| 4,288,942 | A | | 9/1981 | Nicholl | |
| D280,220 | S | | 8/1985 | Blight | |
| D305,344 | S | | 1/1990 | Stanzel | |
| 5,030,157 | A | | 7/1991 | Silverglate | |
| 5,066,258 | A | * | 11/1991 | Tomberlin | 446/40 |
| 5,080,624 | A | * | 1/1992 | Brinker | 446/266 |
| D341,390 | S | | 11/1993 | Nottingham et al. | |
| 5,853,311 | A | * | 12/1998 | Bartholomew | 446/48 |
| 6,247,989 | B1 | * | 6/2001 | Neff | 446/46 |

* cited by examiner

*Primary Examiner*—Jacob K. Ackun
(74) *Attorney, Agent, or Firm*—Kelly Bauersfeld Lowry & Kelley, LLP

(57) ABSTRACT

A flying disk includes an outer ring, a plurality of blades spaced from one another and extending from the outer ring to a central hub to form a top plate thereof. The blades have a leading edge of greater cross-sectional thickness than the trailing edge thereof to provide lift. A bottom plate is attached to the top plate and defines a turbine structure including a series of slots and vanes extending downwardly from an edge of a slot from the bottom plate. The blades cause the disk to rise to a maximum altitude, and as the disk descends, the turbine structure regenerates the spinning motion thereby extending flight time.

21 Claims, 2 Drawing Sheets

FLYING DISK

BACKGROUND OF THE INVENTION

The present invention generally relates to flying toys. More particularly, the present invention relates to a flying disk having a configuration that extends its flight time.

Aerodynamic flying toys with circular, disk-like, ring-like shapes are commonly utilized in games in which players toss them into the air, with a spinning motion, as a form of sport or recreation. The recreational use of flying toys has long been enjoyed by both children and adults and many popular games have involve the flying of such devices between two or more players.

In the usual embodiment, the toy is made of a plastic material, or the like, in the shape of a saucer having a depending rim located around the lower outer marginal edge to facilitate gripping by the user. Throwing is usually accomplished with a wrist snapping motion whereby momentum in a spinning motion is imparted to the toy to cause it to fly or glide through the air. The Frisbee® flying disk, manufactured by the Wam-O Manufacturing Company is an example of such a flying device. The appeal of the toy usually resides in the fact that it exhibits definite aerodynamic characteristics and can be made to do a number of various maneuvers and have a flight time dependent upon the skill of the user.

However, many such flying toys do not have a very long range or flight time unless the user is particularly strong or skilled. It has been found that in addition to the various maneuvers, much satisfaction and joy is derived from the total amount of flight time in which the flying saucer toy remains in the air. Accordingly, there is a continuing need for a flying disk that is designed such so as to extend the overall flight time of the toy. The present invention fulfills this need and provides other related advantages.

SUMMARY OF THE INVENTION

The present invention resides in a flying disk designed such that its flight time is extended in comparison to prior art flying disk toys and the like.

The flying disk includes a top plate comprised of an outer ring, a plurality of blades spaced from one another and extending from the outer ring to a central hub. The plurality of blades each have a leading edge of greater cross-sectional thickness than a trailing edge thereof to serve as air foils. The top plate is generally circular and has an inverted disk-shaped configuration.

A bottom plate is attached to the top plate. The bottom plate is generally planar, circular, and of approximately the same diameter as the top plate. The bottom plate defines a turbine structure comprising a series of slots extending radially outwardly from a central portion of the bottom plate. A series of vanes extend downwardly from edges of the slots.

The bottom plate includes a peripheral flange that frictionally engages the top plate outer ring to form a snap-fit connection. The central hub of the top plate includes an aperture aligned with an aperture extending through the bottom plate for reception of a screw to securely hold the top and bottom plates to one another. A bumper encircles the joined top and bottom plate and is preferably comprised of an elastomeric material to prevent damage to the flying disk.

Upon throwing the disk in spinning motion, similar to a Frisbee® or the like, the blades cause the disk to rise to a maximum altitude. As the disk descends, the turbine structure regenerates the spinning motion, thereby extending the fly time of the flying disk.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
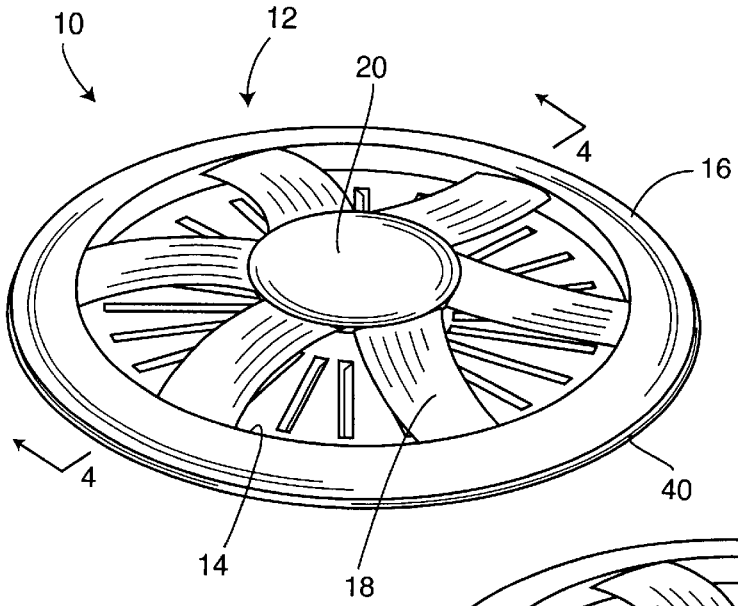
FIG. 1 is a top perspective view of a flying disk embodying the present invention.
Figure 2:
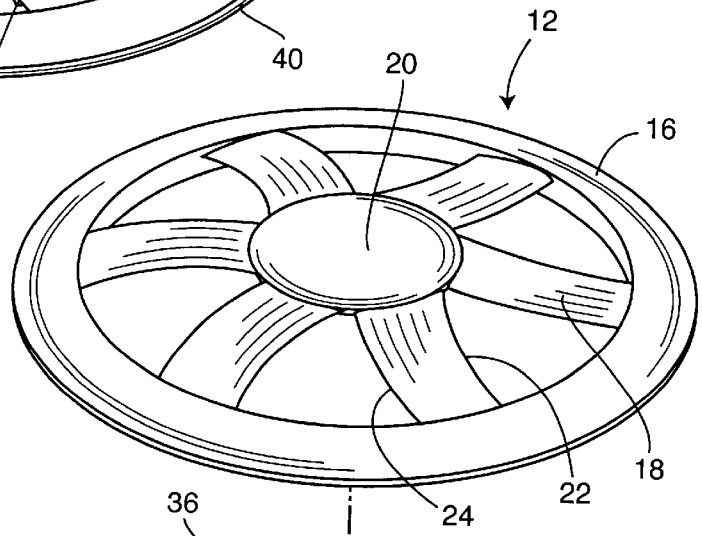
FIG. 2 is an exploded perspective view of the flying disk of FIG. 1.
Figure 2:
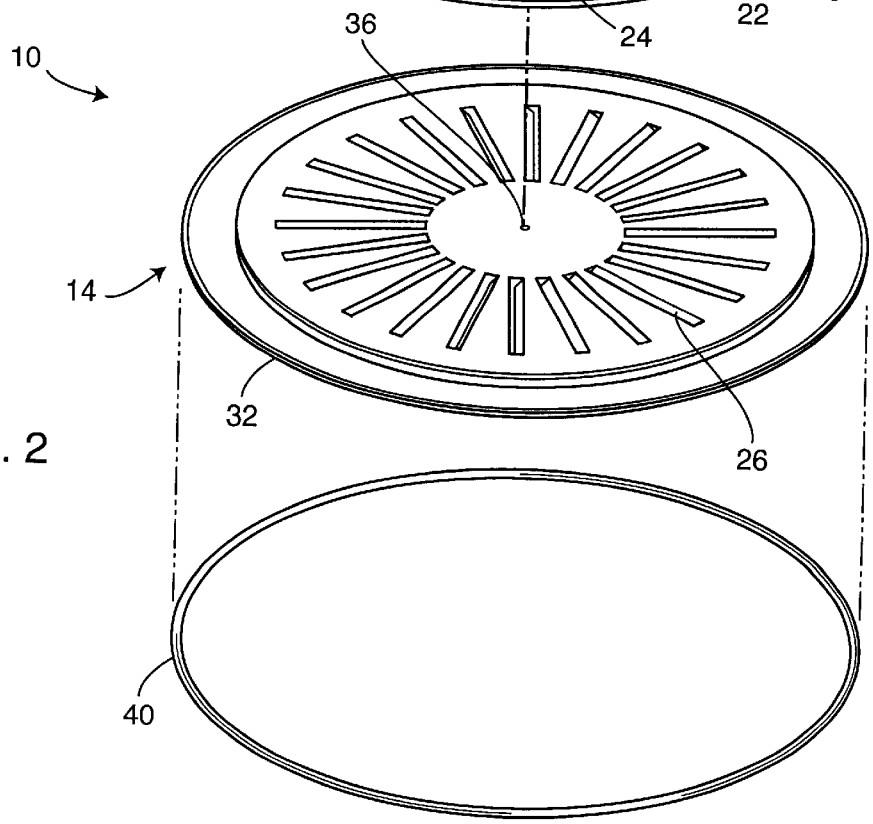

Referring now to FIG. 1, there is shown a perspective view of the aerodynamic flying disk, generally referred to by the reference number 10, of the present invention. As shown in FIG. 2, the disk 10 includes a top plate 12 and a bottom plate 14 which are attached to one another to form a generally inverted saucer shaped flying disk 10.

Figure 4:
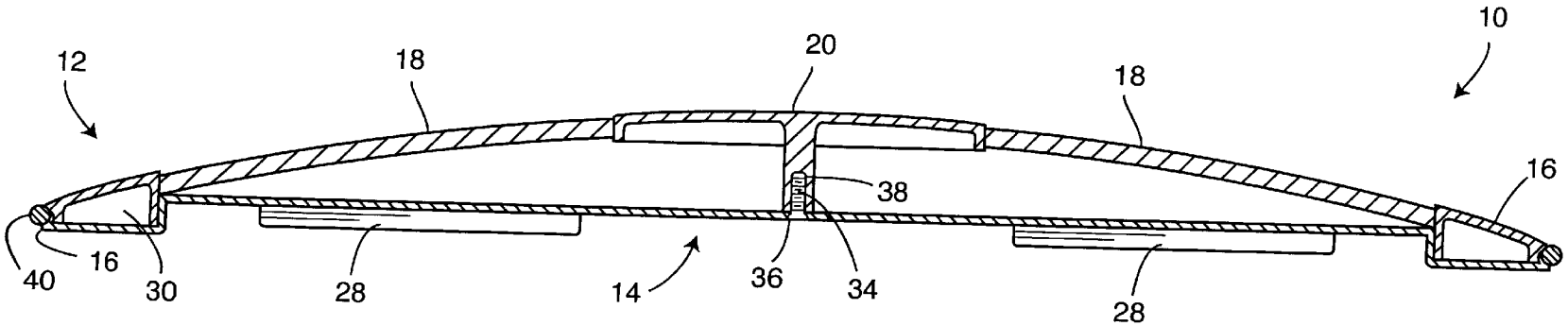
FIG. 4 is a cross-sectional view of the flying disk taken generally along line 4—4 of FIG. 1.

With continuing reference to FIGS. 1 and 2, the top plate 12 includes an outer ring 16. A plurality of blades 18 extend from an inner edge of the ring 16 to a central hub 20. As shown in FIG. 4, the hub 20 is slightly elevated with respect to the circumferential ring 16, thus the blades 18 are somewhat inclined.

The blades 18 are designed such that a leading edge 22-24 thereof is thicker in cross-sectional thickness than a trailing edge 22-24 thereof. Such a configuration causes air to travel a greater distance across the top of the blade 18 than the bottom of the blade 18, thus generating a lower pressure on the top to generate lift. Thus, the plurality of blades 18 form a plurality of air foils radiating from the central hub 20 to the ring 16. The combined air foil effect of the blades 18 causes the disk 10 to elevate during flight, such lift and elevation being further provided by the rotation of the blades 18 as the disk is spun in motion, as will be described more fully herein.

Figure 3:
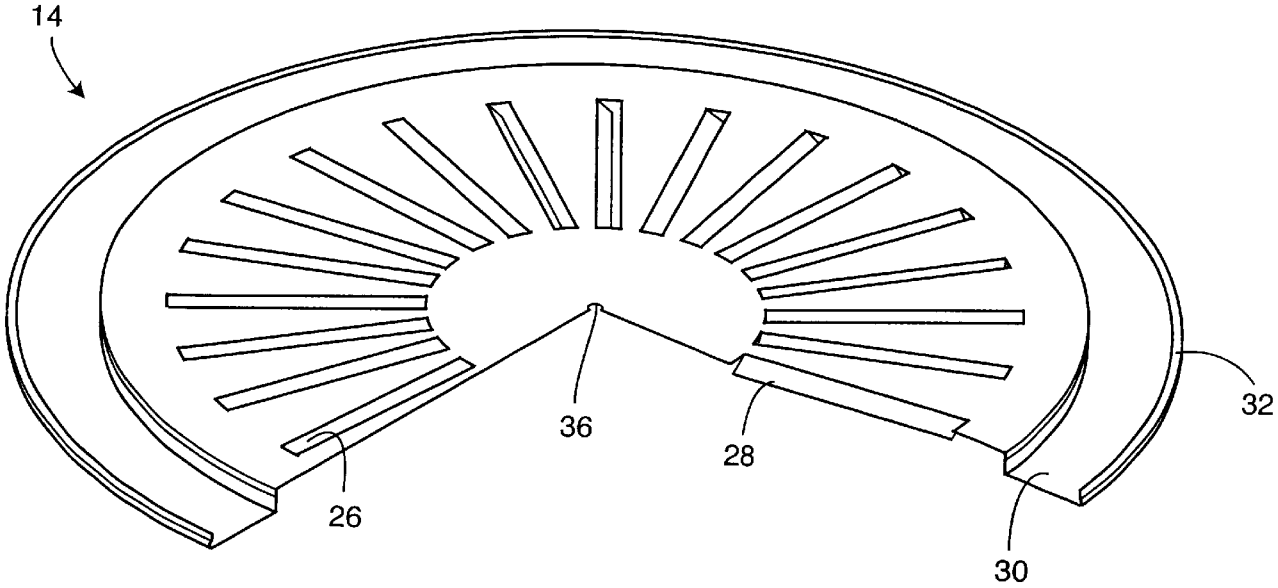
FIG. 3 is a partially fragmented perspective view of a bottom plate component of the flying disk.

With reference now to FIGS. 2 and 3, the bottom plate 14 is also circular and approximates the diameter of the top plate 12. The bottom plate 14 is preferably generally planar, as illustrated. The bottom plate 14 defines a turbine structure that regenerates the spinning motion of the flying disk 10 as the disk descends during its flight. Such turbine structure is comprised of a plurality of slots 26 extending radially from a central portion of the bottom plate 14. As illustrated, the series of slots are generally uniformly spaced and form a circular arrangement. Associated with each slot 26 is a vane 28 which is typically substantially identical in length and width as the slot 26 and extends downwardly from the bottom plate 14 at an angle with respect to the edge of the slot 26. On descent of the flying disk 10, the movement of air caused by the vanes 28 and slots 26 create a turbine-effect causing the disk to spin and descend more slowly than it otherwise would.

With reference now to FIGS. 3 and 4, a circumferential groove 30 formed on the one side by a generally elevated top surface of the bottom plate 14, and on the outer side thereof by a circumferential flange 32. As shown in FIG. 4, the ring 16 of the top plate 12 frictionally engages the flange 32 of the bottom plate 14 so as to partially reside within the open-faced groove 30. For a more secure connection, a screw 34 or the like may be inserted through a central aperture 36 of the bottom plate 14 and threadably received by an interiorally threaded aperture 38 aligned with the bottom plate aperture 36 when the top and bottom plate 12 and 14 are connected to one another. A circular safety bumper 40 is wrapped around the perimeter of the joined top and bottom plates 12 and 14 so as to protect the flying disk 10 and objects or persons with which it comes into contact with. Preferably, the bottom plate outer flange 32 and top plate ring 16 include recesses which accept the circular bumper 40, as shown in FIG. 4.

In using the flying disk 10 constructed as described, a user grips the disk 10 at one side with the thumb on an upper surface of the ring 16 and one or more fingers on a lower surface of the bottom plate 14. The disk 10 is then thrown by the user swinging his or her arm in and snapping the wrist to throw the disk 10 into the air with a spinning motion. As the disk 10 moves through the air, the air passing over the blades 18 provides an aerodynamic lift. As the flying disk 10 reaches an apex point of its flight, and begins to descend, the turbine structure regenerates the spinning motion, thereby extending its flight time.

Although an embodiment has been described in detail for purposes of illustration, various modifications may be made without departing from the scope and spirit of the invention. Accordingly, the invention is not to be limited, except as by the appended claims.

What is claimed is:

1. A flying disk, comprising:

a top plate including an outer ring, a plurality of blades spaced from one another and extending from the outer ring to a central hub; and a bottom plate attached to the top plate and defining a turbine structure, wherein. upon throwing the disk in spinning motion, the blades cause the disk to rise to a maximum altitude, and as the disk descends the turbine structure regenerates the spinning motion, thereby extending its flight time.

2. The disk of claim 1, wherein the plurality of blades have a leading edge of greater cross-sectional thickness than a trailing edge thereof.

3. The disk of claim 1, wherein the top plate has a generally inverted disc-shaped configuration.

4. The disk of claim 1, wherein the bottom plate is generally planar.

5. The disk of claim 1, wherein the turbine structure comprises a series of vanes extending radially and downwardly from the bottom plate.

6. The disk of claim 5, wherein the turbine structure further includes a series of slots extending radially outwardly from a central portion of the bottom plate and disposed over the vanes.

7. The disk of claim 1, wherein the bottom-plate includes a peripheral flange that frictionally engages the top plate outer ring.

8. The disk of claim 1, wherein the top plate central hub includes an aperture aligned with an aperture extending through the bottom plate for reception of a screw.

9. The disk of claim 1, wherein the top plate and bottom plate are generally circular.

10. The disk of claim 1, wherein the top plate and the bottom plate have substantially identical diameters.

11. The disk of claim 1, including a bumper encircling the joined top and bottom plate.

12. A flying disk, comprising:

a top plate including an outer ring, a plurality of blades spaced from one another and extending from the outer ring to a central hub, a leading edge of each blade being of greater cross-sectional thickness than a trailing edge thereof; and a bottom plate attached to the top plate and defining a turbine structure comprised of a series of slots extending radially from a central portion of the bottom plate, and a series of vanes extending radially from edges of the slots;

wherein upon throwing the disk in spinning motion, the blades cause the disk to rise to a maximum altitude, and as the disk descends the turbine structure regenerates the spinning motion, thereby extending its flight time.

13. The disk of claim 12, wherein the top plate has a generally inverted disc-shaped configuration, and wherein the bottom plate is generally planar.

14. The disk of claim 12, wherein the bottom plate includes a peripheral flange that frictionally engages the top plate outer ring.

15. The disk of claim 12, wherein the top plate central hub includes an aperture aligned with an aperture extending through the bottom plate for reception of a screw.

16. The disk of claim 12, wherein the top plate and bottom plate are generally circular, and have substantially identical diameters.

17. The disk of claim 12, including a bumper encircling the joined top and bottom plate.

18. A flying disk, comprising:

a generally circular top plate having a generally inverted disc configuration, the top plate including an outer ring, a plurality of blades spaced from one another and extending from the outer ring to a central hub, a leading edge of each blade being of greater cross-sectional thickness than a trailing edge thereof; and a generally planar and circular bottom plate of similar diameter as the top plate and attached to the top plate and defining a turbine structure comprised of a series of slots extending radially from a central portion of the bottom plate, and a series of vanes extending downwardly from edges of the slots;

wherein upon throwing the disk in spinning motion, the blades cause the disk to rise to a maximum altitude, and as the disk descends the turbine structure regenerates the spinning motion, thereby extending its flight time.

19. The disk of claim 18, wherein the bottom plate includes a peripheral flange that frictionally engages the top plate outer ring.

20. The disk of claim 18, wherein the top plate central hub includes an aperture aligned with an aperture extending through the bottom plate for reception of a screw.

21. The disk of claim 18, including a bumper encircling the joined top and bottom plate.

* * * * *